US009795273B2

(12) United States Patent
Pyo

(10) Patent No.: US 9,795,273 B2
(45) Date of Patent: Oct. 24, 2017

(54) DISHWASHER

(71) Applicant: LG ELECTRONICS INC., Seoul (KR)

(72) Inventor: Joonho Pyo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 634 days.

(21) Appl. No.: 14/149,933

(22) Filed: Jan. 8, 2014

(65) Prior Publication Data

US 2014/0216507 A1 Aug. 7, 2014

(30) Foreign Application Priority Data

Feb. 4, 2013 (KR) ..... 10-2013-0012414

(51) Int. Cl.
*A47L 15/23* (2006.01)
*A47L 15/42* (2006.01)

(52) U.S. Cl.
CPC ..... *A47L 15/428* (2013.01); *A47L 15/23* (2013.01); *A47L 15/4223* (2013.01)

(58) Field of Classification Search
CPC .. A47L 15/23; A47L 15/4221; A47L 15/4282; A47L 15/428; A47L 15/508
USPC ..... 134/176, 179, 183, 144, 111, 148, 198, 134/56 D, 58 D, 57 D, 191, 178;
(Continued)

(56) References Cited

U.S. PATENT DOCUMENTS 3,774,626 A * 11/1973 Schweitzer ..... A47L 15/23 134/179
4,174,723 A 11/1979 Long
(Continued)

FOREIGN PATENT DOCUMENTS

CN 2376264 Y 5/2000
CN 2416854 Y 1/2001
CN 1550201 A 12/2004
(Continued)

OTHER PUBLICATIONS

Inui et al., "Dishwasher, has valve body switching multiple flow paths" Nov. 2011, JP 2011-224233, Machine Translation.*
(Continued)

*Primary Examiner* — David Cormier
*Assistant Examiner* — Thomas Bucci
(74) *Attorney, Agent, or Firm* — KED & Associates, LLP

(57) ABSTRACT

A dishwasher is provided that may include a tub; first and second racks disposed in the tub to accommodate objects to be washed; a lower arm having a lower arm chamber that allows wash water to flow thereinto, an arm channel that communicates with the lower arm chamber through an arm channel communication hole to spray the wash water onto the second rack, a detachable chamber separated from the lower arm chamber by a chamber partition wall, and a chamber communication hole provided in the chamber partition wall to allow the lower arm chamber to communicate with the detachable part chamber; a tower nozzle provided to the second rack to spray the wash water onto the first rack; and a tower connection part withdrawable from the detachable chamber according to water pressure in the detachable chamber and adapted to supply the wash water to the tower nozzle when withdrawn from the detachable chamber.

16 Claims, 13 Drawing Sheets

(58) Field of Classification Search
USPC ..... 239/251, 261, 264, 245, 246, 244, 113, 239/227, 243, 258, 164, 206, 222.17, 583
See application file for complete search history.

(56) References Cited

U.S. PATENT DOCUMENTS 4,509,687 A * 4/1985 Cushing ..... A47L 15/23 134/179
5,427,129 A * 6/1995 Young, Jr. ..... A47L 15/23 134/176

FOREIGN PATENT DOCUMENTS

CN 102858221 A 1/2013
JP 2011224233 A * 11/2011

OTHER PUBLICATIONS

Chinese Office Action dated Mar. 2, 2016 issued in Application No. 201410014197.4 (Full Chinese Text and English Translation).

* cited by examiner

DISHWASHER

CROSS-REFERENCE TO RELATED APPLICATION(S)

This application claims priority to Korean Patent Application No. 10-2013-0012414, filed in Korea on Feb. 4, 2013, which is hereby incorporated by reference as if fully set forth herein.

BACKGROUND

1. Field

A dishwasher is disclosed herein.

2. Background

In general, a dishwasher is a device that removes remaining dirt from dishes and cooking utensils (hereinafter, referred to as "washing objects") accommodated in a washing space using wash water (and even dries the washing objects in some cases). FIG. 1 shows a conventional dishwasher.

The conventional dishwasher of FIG. 1 includes a cabinet 200 having a tub 210 that provides a washing space, an upper rack 220 and a lower rack 230 provided inside the tub 210 to accommodate a washing object, a sump 240 positioned under the tub 210 to store wash water, a lower arm 260 to spray the wash water onto the lower rack 230, an upper arm 250 to spray the wash water to or onto the upper rack 220, a pump P to supply the wash water from the sump 240 to the lower arm 260 through a first channel P1, and a second channel P2 branched from the first channel P1 to supply the wash water to the upper arm 250. The sump 240 receives the wash water supplied thereto through a water supply channel 241. The sump 240 drains the wash water therefrom through a drainage channel 243. The second channel P2 receives the wash water introduced into the first channel P1 through a valve V and provides the wash water to the upper arm 250.

However, the conventional dishwasher can wash the washing objects held on the upper rack only when the upper arm 250 is positioned between the upper rack 220 and the lower rack 230. Accordingly, the conventional dishwasher needs to essentially have a space to arrange the upper arm 250 between the upper rack 220 and the lower rack 230. Accordingly, in the case of the conventional dishwasher, a volume of the tub is limited, and thus, heights of the racks 220 and 230 or a size of a washing object to be accommodated in the racks 220 and 230 may be limited by a position of the upper arm 250. In addition, in the conventional dishwasher, the second channel P2 to supply wash water to the upper arm 250 needs to be positioned on an inner circumferential surface of the tub. Therefore, lengths and positions of the racks 220 and 230 may be limited by a position of the second channel P2.

BRIEF DESCRIPTION'OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. Wherever possible, the same reference numbers will be used throughout the drawings to refer to the same or like parts.

It should be understood that the configuration and control method of an apparatus described below are provided to illustrate embodiments, and are not intended to limit the scope.

Figure 1:
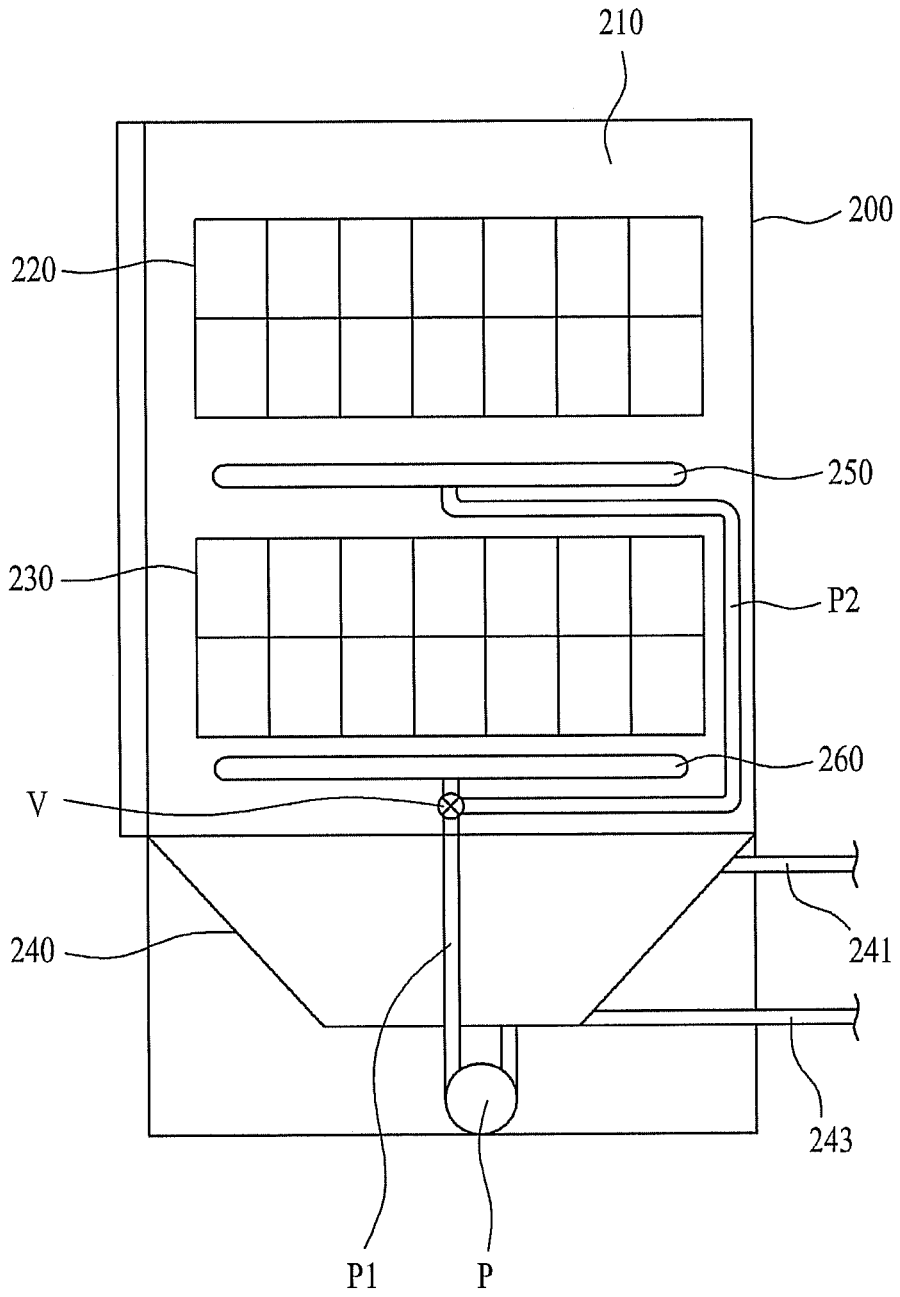
FIG. 1 is a schematic cross-sectional view of a conventional dishwasher.
Figure 2:
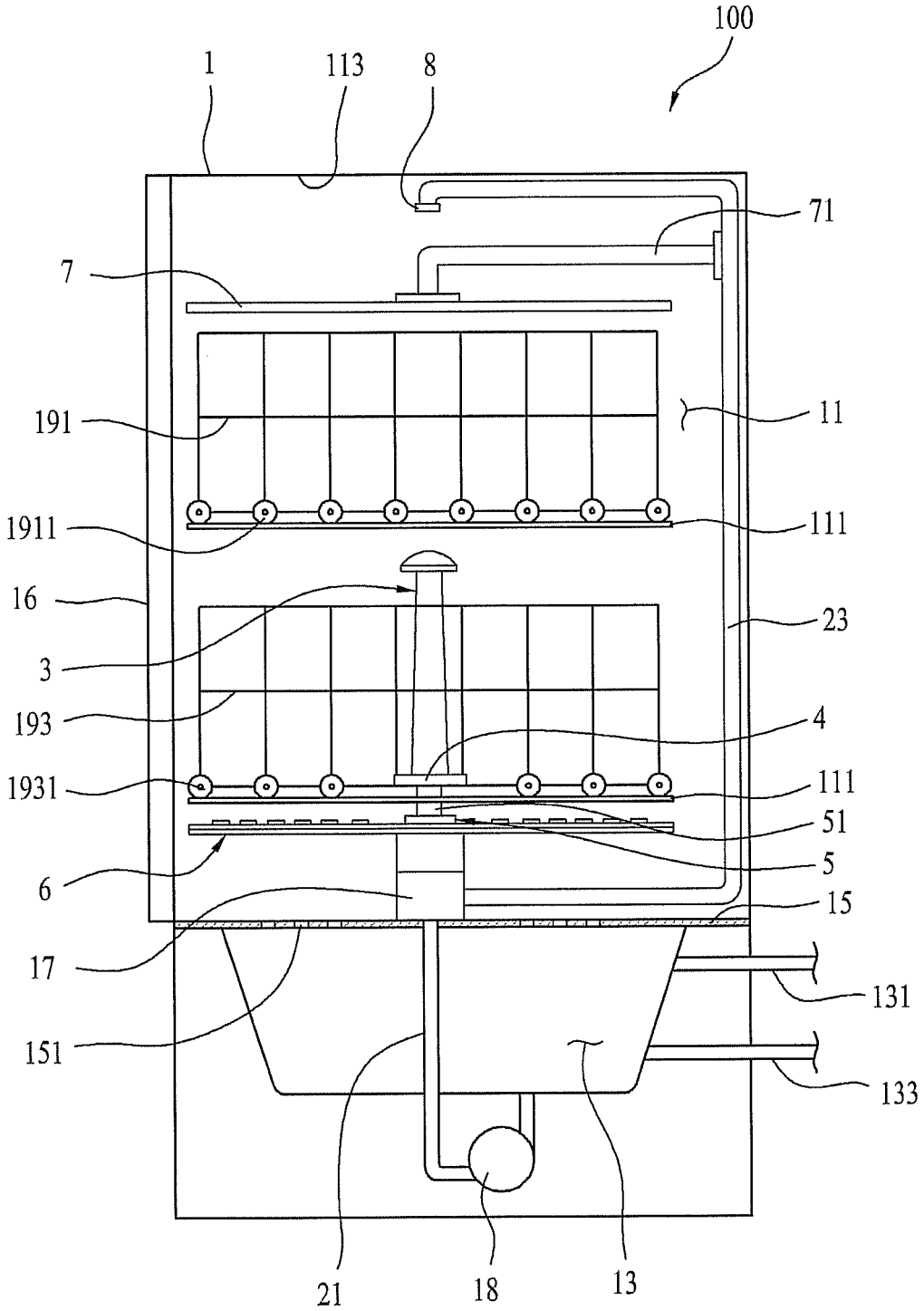
FIG. 2 is a schematic cross-sectional view of a dishwasher according to an embodiment.

FIG. 2 is a schematic cross-sectional view of a dishwasher according to an embodiment. The dishwasher 100 may include a cabinet 1 that forms an external appearance of the dishwasher 100, a tub 11 positioned in the cabinet 1 to provide a washing space, a sump 13 positioned under the tub 11 to store wash water, a sump cover 15 positioned on the sump 13 to divide the tub 11 from the sump 13, and a door 16 provided to open and close the washing space.

A sump water supply channel 131 to supply the washing water to the sump 13 and a drainage channel 133 to drain the washing water from the sump 13 may be connected to the sump 13. The sump cover 15 may have a collection hole 151, which will be described later, to collect the washing water sprayed into the washing space through spray arms 6 and 7 and a top nozzle 8 to the sump 13.

A rack may be provided inside the tub 11 to accommodate washing objects, such as dishes. The rack may include a first rack 191 and a second rack 193 positioned below the first rack 191. For ease of description, the first rack 191 will be referred to as an upper rack, and the second rack 193 will be referred to as a lower rack.

The upper rack 191 and the lower rack 193 may be arranged to be drawn out of the tub 11 when the door 16 is opened opening the washing space. To this end, rails 111 directed toward the door 16 may be provided on an inner circumferential surface of the tub, and the upper rack 191 and the lower rack 193 may further have wheels 1911 and 1931 that support the racks on the rails 111, respectively.

The dishwasher according to embodiments may include lower spray arm 6 provided in the tub 11 to wash the washing objects accommodated in the lower rack 193, upper spray arm 7 to wash the washing objects accommodated in the upper rack 191, and top nozzle 8 positioned at an uppermost portion of the tub 11 to spray wash water. The lower arm 6 may be rotatably fixed to an interior of the tub 11 by an arm holder 17 fixed to the sump cover 15, and receive wash water stored in the sump 13 through a water supply pump 18 and a water supply channel.

The water supply channel may include a first channel 21 that connects the water supply pump 18 to the arm holder 17, and a second channel 23 that connects the arm holder 17 to the top nozzle 8. In this case, the upper arm 7 may be connected to the second channel 23 via a second channel connection pipe 71.

The wash water discharged from the sump 13 through the water supply pump 18 may be supplied to the arm holder 17 through the first channel 21. A portion of the wash water supplied to the arm holder 17 may be supplied to the lower arm 6, which may communicate with the arm holder 17, while the remainder of the wash water may move along the second channel 23. Meanwhile, a portion of the wash water introduced into the second channel 23 may be supplied to the upper arm 7 through the second channel connection pipe 71, and the remainder of the wash water may move toward the top nozzle 8.

The upper arm 7 may be positioned over the upper rack 191. The upper arm 7 may be rotatably coupled to the second channel connection pipe 71 such that the upper arm 7 may be rotated by repulsive force of the wash water produced when it sprays the wash water.

The top nozzle 8 may be arranged at a higher position (that is, at an upper surface 113 of the tub) than the upper arm 7. The top nozzle 8 may be a means to receive wash water from the second channel 23 and spray the same onto the upper rack 191 and the lower rack 193.

According to embodiments, washing objects accommodated in the lower rack 193 may be washed by the lower arm 6, and washing objects accommodated in the upper rack 191 may be washed by a tower nozzle 3. Accordingly, the upper arm 7 and the top nozzle 8 may be omitted. In the case that the upper arm 7 and the top nozzle 8 are not provided in the tub 11, a height of the dishwasher according to embodiments may be minimized.

That is, the dishwasher 100 may include the tower nozzle 3 fixed to the lower rack 193 and extending toward the upper rack 191, and a tower connection part 5 provided to or at the lower arm 6 and having a tower detachable pipe 51 connected to or detached from the tower nozzle 3 according to a water pressure in the lower arm 6.

Figure 3:
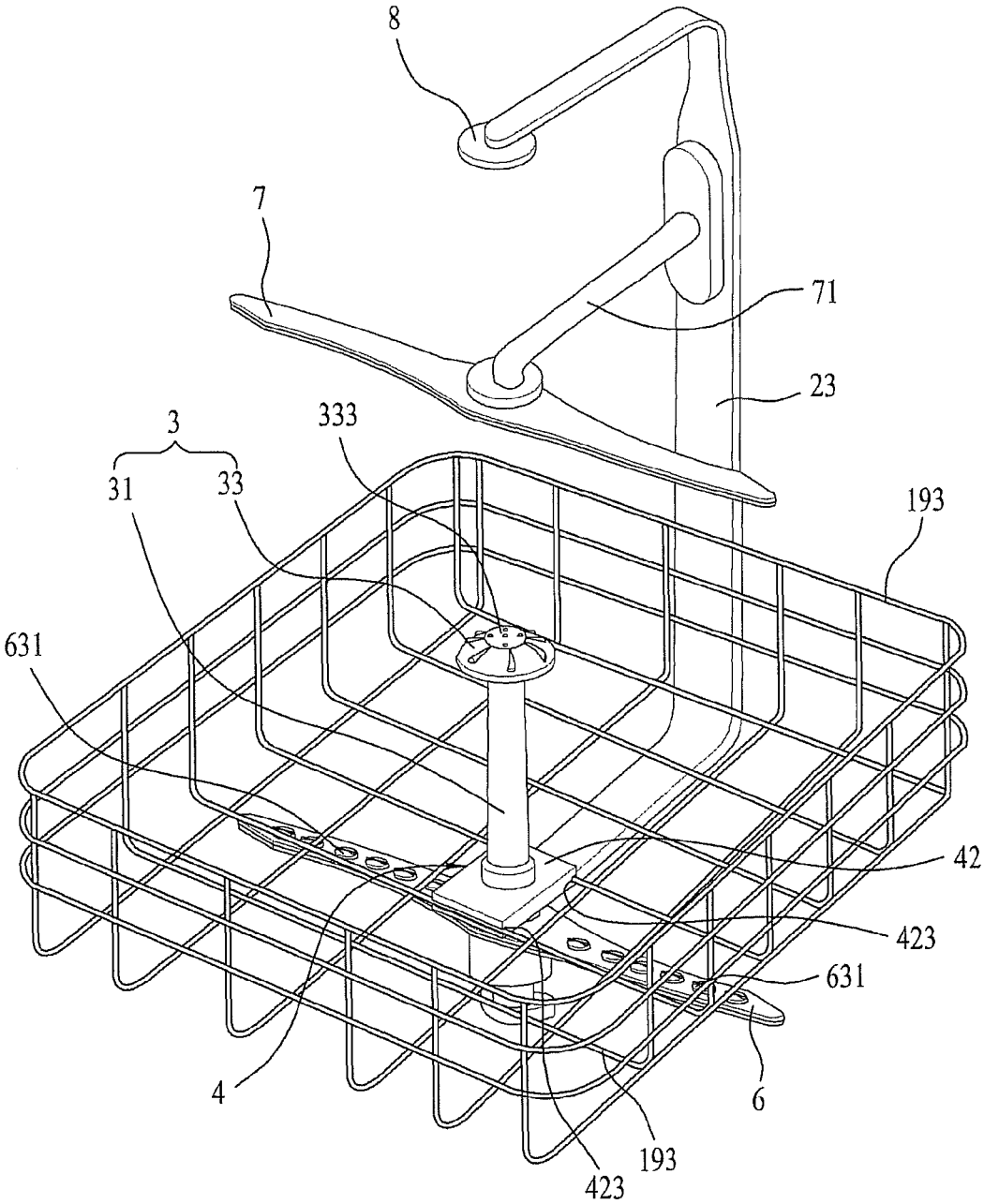
FIG. 3 is a schematic perspective view of a tower nozzle and a lower rack of a dishwasher according to an embodiment.

As shown in FIGS. 3 and 4, the tower nozzle 3 may be detachably connected to the lower rack 193 via a rack fixing part 4. Further, the tower nozzle 3 may include a tower channel 31 coupled to the rack fixing part 4 to guide the wash water supplied through the tower connection part 5 to the upper rack 191, and a spray nozzle 33 to spray the wash water supplied through the tower channel 31. The tower channel 31 may be formed in the shape of a cylinder whose upper and lower surfaces are open. The spray nozzle 33 may be coupled to the open upper surface, and the rack fixing part 4, which will be described later, may be coupled to the open lower surface.

In addition, a diameter of the tower channel 31 may decrease as the tower channel 31 extends from a lower side to an upper side. Thereby, the wash water introduced into the tower channel 31 through the lower surface of the tower channel 31 may move toward the spray nozzle 33, maintaining a constant pressure.

Figure 4A:
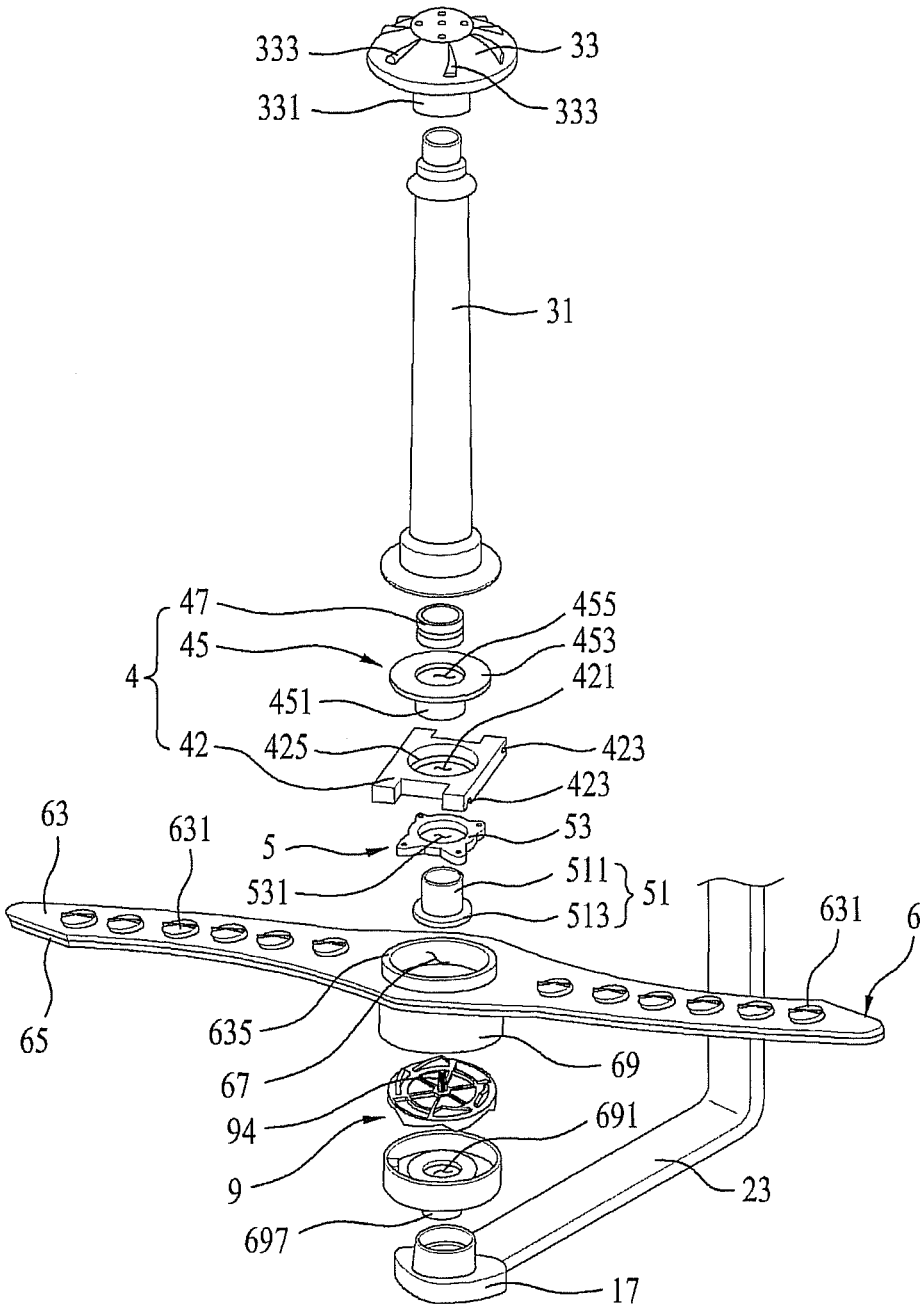
FIGS. 4A-4B are an exploded schematic perspective view of the tower nozzle, a rack fixing part, a tower connection part, and a lower arm and a schematic top view of a spray nozzle of the dishwasher of FIG. 3.
Figure 4B:
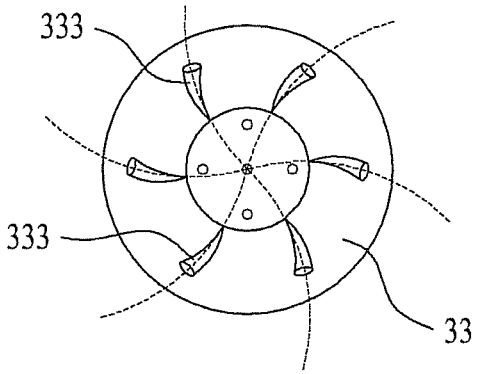

The spray nozzle 33 may include, as shown in FIG. 4, a connection pipe 331 coupled to the upper surface of the tower nozzle 3, and a plurality of spray holes 333 to discharge the wash water introduced into the plurality of spray nozzle 33 through the connection pipe 331 from the spray nozzle 33. The connection pipe 331 may couple the tower channel 31 to the spray nozzle 33 such that the spray nozzle 33 is rotatable. The plurality of spray holes 33 may be arranged to allow the spray nozzle 33 to rotate according to a repulsive force of the wash water discharged from the spray nozzle 33. That is, the spray holes 33 may be arranged on an upper surface of the spray nozzle 33 in a spiral pattern (see FIG. 4B), thereby rotating the spray nozzle 33 clockwise or counterclockwise when the wash water is sprayed.

The rack fixing part 4 may include a rack fixing body 42 fixed to the lower rack 193 to support the tower channel 31 and a detachable pipe coupling part 45 to which the tower connection part 5, which may extend out of the lower arm 6, may be connected. The rack fixing body 42 may be provided with a fixing body through-hole 421 and a rack coupling part 423, as shown in FIG. 4A. The fixing body through-hole 421 may be arranged to pass through the rack fixing body 42, and the detachable pipe coupling part 45 may be inserted into the fixing body through-hole 421.

The rack coupling part 423, which is a means to connect and detach the rack fixing body 42 to and from the lower rack 193, may be formed by concavely curving a surface of the rack fixing body 42. The rack coupling part 423 may have any structure, for example, a hook that allows the rack fixing body 42 to be connected to and detached from the lower rack 193.

The detachable pipe coupling part 45 may include a coupling part body 451 inserted into the fixing body through-hole 421 and having a cylindrical shape, and a coupling part flange 453 provided on an outer circumferential surface of the coupling part body 451. The coupling part body 451 may be provided with a detachable pipe accommodation hole 455 that penetrates a center of the coupling part body 451 and communicates with the tower channel 31. The tower detachable pipe 51, which may extend out of the lower arm 6, may be inserted into the detachable pipe accommodation hole to allow the wash water to be supplied to the tower channel 31 therethrough.

The coupling part flange 453 may protrude from the outer circumferential surface of the coupling part body 451. The coupling part flange 453 may be supported by a flange seating groove 425, which may be formed by concavely curving the surface of the rack fixing body 42.

The coupling part body 451 may have a smaller diameter than a diameter of the fixing body through-hole 421, and the coupling part flange 453 may have a larger diameter than the diameter of the fixing body through-hole 421 and smaller than a diameter of the flange seating groove 425. By being seated in the flange seating groove 425, the coupling part flange 453 may prevent the coupling part body 451 from being taken out of the rack fixing body 42 and allow the coupling part body 451 to move within the fixing body through-hole 421.

As the coupling part body 451 is movably provided to the rack fixing body 42, the dishwasher 100 facilitates coupling between the tower detachable pipe 51 and the detachable pipe accommodation hole even in a case that a center of a detachable pipe body 511 is not aligned with a center of the detachable pipe accommodation hole due to a position of the lower rack 193, or the lower rack 193 rotates without being balanced.

Figure 5:
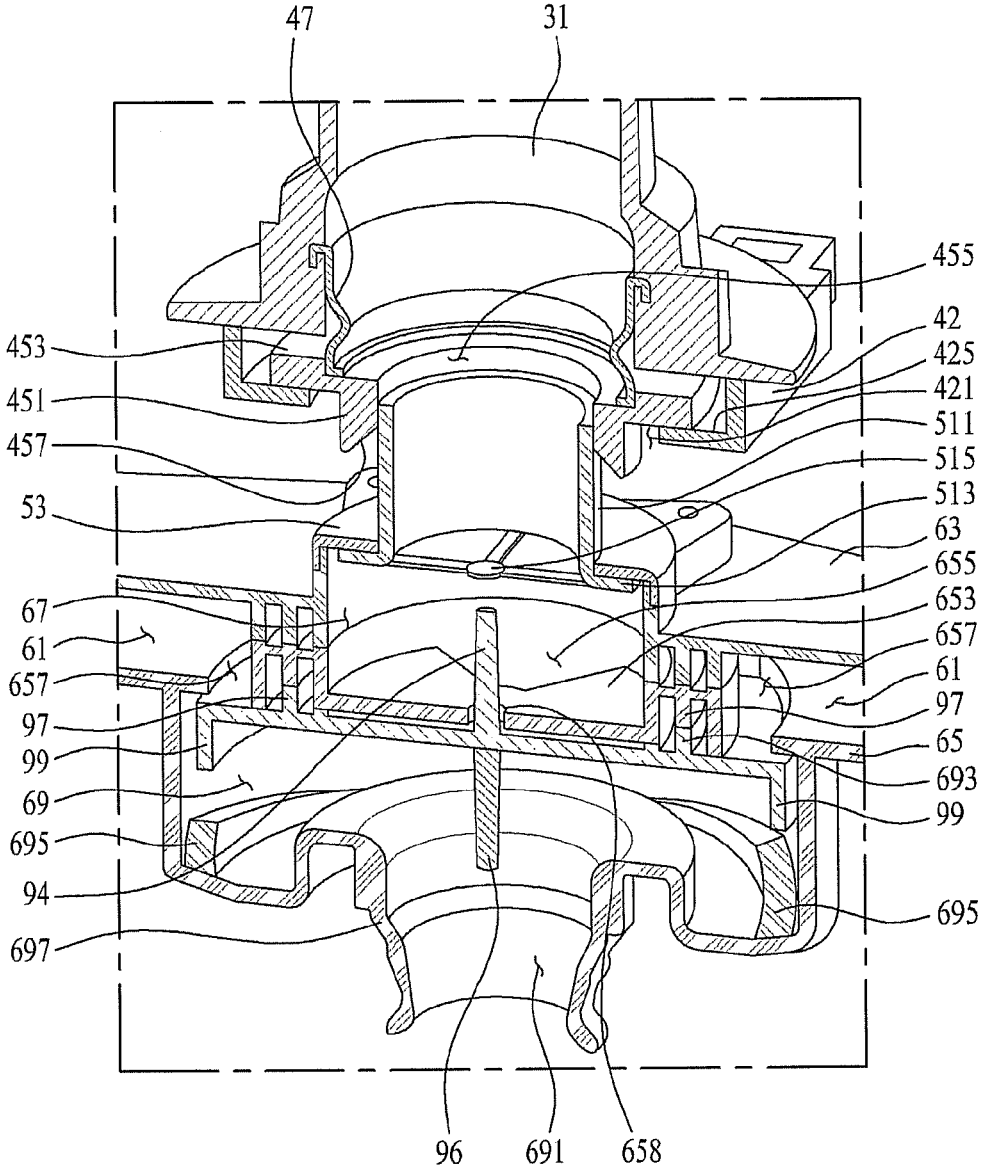
FIG. 5 is a schematic cross-sectional view of coupling structure of the tower nozzle, rack fixing part, tower connection part, and lower arm of the dishwasher of FIG. 3.

Further, the rack fixing part 4 may further include an elastic supporting part 47 that elastically supports the detachable pipe coupling part 45. As shown in FIG. 5, one end of the elastic supporting part 47 may be coupled to the tower channel 31, and the other end thereof may be coupled to the coupling part body 451. Accordingly, the coupling part body 451 may not only be movable within the fixing body through-hole 421, but may also be maintained at a constant position in the fixing body through-hole 421 by the elastic supporting part 47. In addition, the coupling part body 451 may further include an inclined surface 457 to guide the detachable pipe body 511 to the detachable pipe accommodation hole.

The tower connection part 5, which may be arranged to be withdrawable from the lower arm 6 to supply wash water to the tower nozzle 3, may be provided with the tower detachable pipe 51 arranged to be withdrawable from a detachable pipe chamber 67 of the lower arm 6, and an arm fixing body 53 fixed to the lower arm 6.

The tower connection part 5 may be withdrawn from the lower arm 6 and connected to the detachable pipe accommodation hole according to an inner pressure of the detachable pipe chamber 67, which will be described later. Once the tower connection part 5 is connected to the detachable pipe accommodation hole, wash water may be supplied to the tower channel 31, which will be described in detail later.

The tower detachable pipe 51 may be provided with the detachable pipe body 511 formed in the shape of a cylinder having an open upper surface and an open lower surface and a detachable pipe flange 513 that protrudes from an outer circumferential surface of the detachable pipe body 511. A guider support 515 may be provided in the detachable pipe body 511. The guider support 515 may be fixed to an interior of the detachable pipe body 511 by a plurality of ribs that extends from an inner circumferential surface of the detachable pipe body 511.

The guider support 515 is a means by which a detachable pipe guider 94 provided to a channel switching part 9 may contact the detachable pipe body 511. Wash water moves in the detachable pipe body 511 through the spaces between the ribs fixing the guider support 515.

The arm fixing body 53 may be fixed to an upper portion of the detachable pipe chamber 67, provided to the lower arm 6, to prevent the tower detachable pipe 51 from being withdrawn from the detachable pipe chamber 67. The arm fixing body 53 may include a through-hole 531 through which the detachable pipe body 511 may pass. A diameter of the through-hole 531 may be almost the same as a diameter of an outer circumferential surface of the detachable pipe body 511 and smaller than a diameter of the detachable pipe flange 513.

The lower arm 6 according to this embodiment may include a lower arm chamber 69 that communicates with the arm holder 17 and that allows wash water to flow thereinto, an arm channel 61 that communicates with the lower arm chamber 69 to spray wash water onto the lower rack 193, and the detachable pipe chamber 67 arranged separately from the arm channel 61, which communicates with the lower arm chamber 69. The tower detachable pipe 51 may be accommodated in the detachable pipe chamber 67.

Figure 6A:
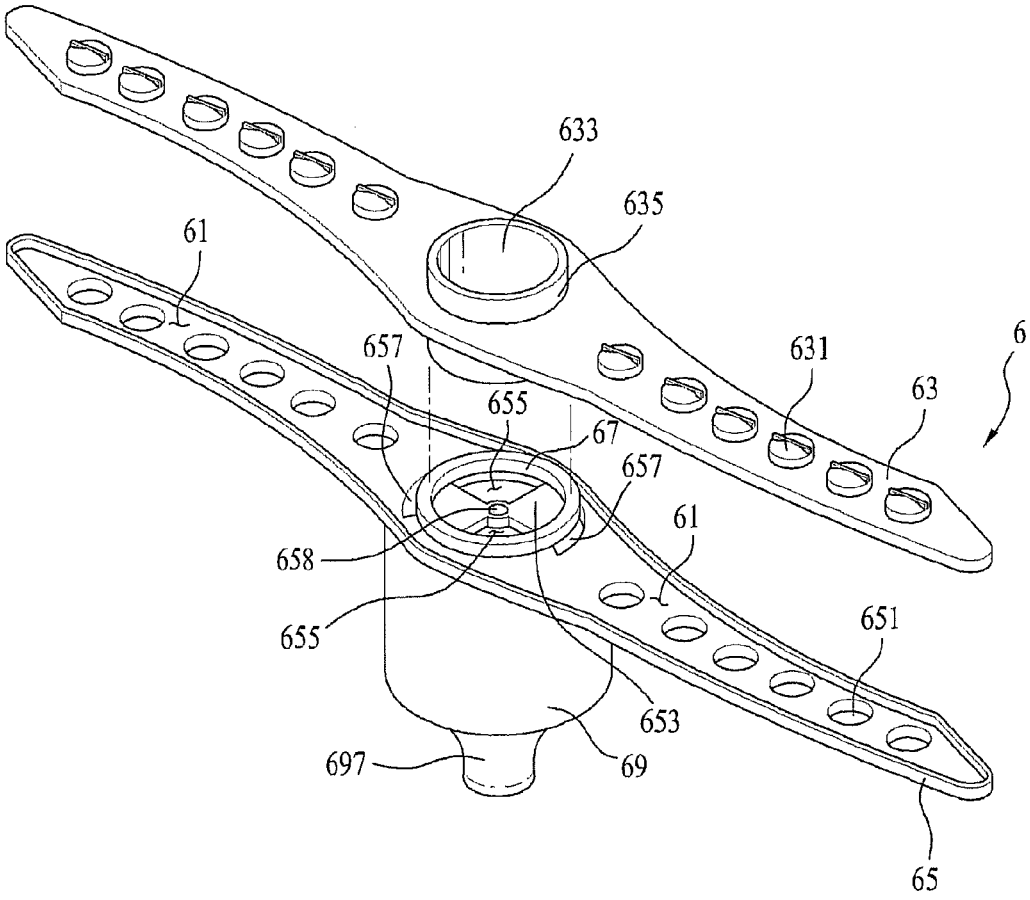
FIGS. 6A-6B are an exploded perspective view and side view of the lower arm of the dishwasher of FIG. 3.

As shown in FIG. 5, the arm channel 61 may be formed by an upper frame 63 and a lower frame 65, and may communicate with the lower arm chamber 69 through an arm channel communication hole 657. As shown in FIG. 6, the upper frame 63 may include an upper spray hole(s) 631, through which the wash water in the arm channel 61 may be sprayed onto the lower rack 193, a frame through-hole 633 to accommodate the tower detachable pipe 51, and a fixing body connection part 635 coupled to the arm fixing body 53.

The lower frame 65 may include an arm channel communication hole 657 that connects the lower arm chamber 69 to the arm channel 61, a lower spray hole 651 that allows the wash water introduced into the arm channel 61 to be sprayed toward the sump cover 15, a chamber partition wall 653 that divides the lower arm chamber 69 and the detachable pipe chamber 67, and a chamber communication hole 655 provided in the chamber partition wall to connect the lower arm chamber 69 to the detachable pipe chamber 67. The detachable pipe chamber 67 may be positioned between one arm channel communication hole 657 and another arm channel communication hole 657, and provided with a wall that extends from the lower frame 65 toward the fixing body connection part 635 of the upper frame 63. The chamber partition wall 653 may be provided with a partition wall through-hole 658 into which the detachable pipe guider 94 provided to the channel switching part 9 may be inserted.

As shown in FIG. 5, the lower arm chamber 69 may be arranged under the lower frame 65 in a manner to surround the arm channel communication hole 657. The lower arm chamber 69 may include an arm holder connection pipe 697 rotatably coupled to the arm holder 17, an inflow hole 691 that penetrates the arm holder connection pipe to allow wash water to flow into the lower arm chamber 69 therethrough, a lower gear engagement part 695 provided to or at a bottom surface of the lower arm chamber 69, and an upper gear engagement part 693 provided to or at an upper surface of the lower arm chamber 69 (such as the chamber partition wall 653). The lower gear engagement part 695 is a means to rotate the channel switching part 9 a certain angle by being coupled to a lower gear 99 of the channel switching part 9, which will be described later. The lower gear engagement part 695 may be arranged along an inner circumferential surface of the bottom surface of the lower arm chamber 69.

The upper gear engagement part 693 is a means to rotate the channel switching part 9 a certain angle by being coupled to an upper gear 97 of the channel switching part 9. The upper gear engagement part 693 may be provided to or at the upper surface of the lower arm chamber 69 and arranged in a space between the detachable pipe chamber 67 and the arm channel communication hole 657. That is, the upper gear engagement part 693 may be arranged in the space between the detachable pipe chamber 67 and the arm channel communication hole 657 along an circumferential surface of the detachable pipe chamber 67.

Figure 6B:
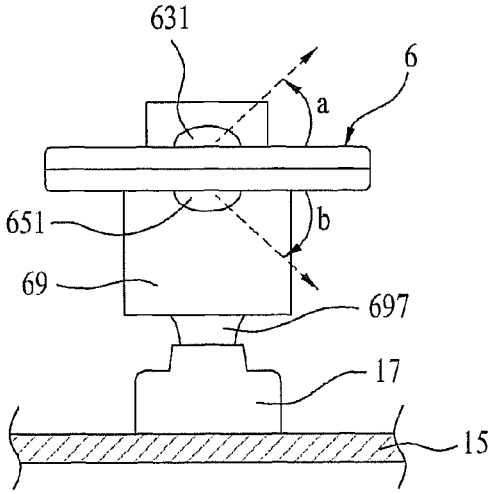

The upper spray hole(s) 631 provided to or in the upper frame 63 may be arranged to allow the wash water to be sprayed at an inclined angle a with respect to a surface of the upper frame 63, such that the lower arm 6 is rotated about the arm holder connection pipe 697 by the repulsive force of the wash water discharged from the arm channel 61, as shown in FIG. 6B. The lower spray hole(s) 651 provided to or in the lower frame 65 may also be arranged to allow the wash water to be sprayed at an inclined angle b with respect to a surface of the lower frame 65, such that the lower arm 6 is rotated about the arm holder connection pipe 697 by the repulsive force of the wash water discharged from the arm channel 61. As the lower spray hole(s) 651 allows the wash water to be sprayed toward the sump cover 15, foreign substances may be prevented from clogging the collection hole 151 of the sump cover 15 when the lower arm 6 rotates.

Figure 7A:
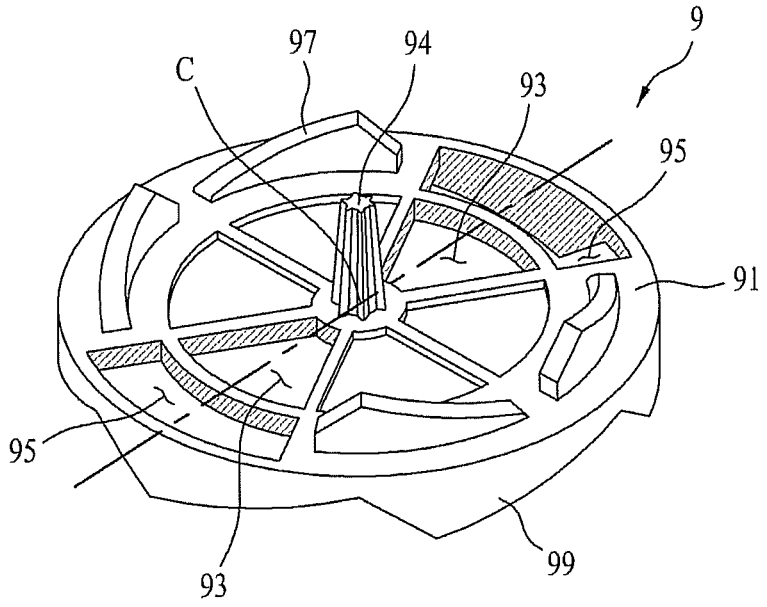
FIGS. 7A-7B are schematic perspective and side views of a channel switching part of the dishwasher of FIG. 3.
Figure 7B:
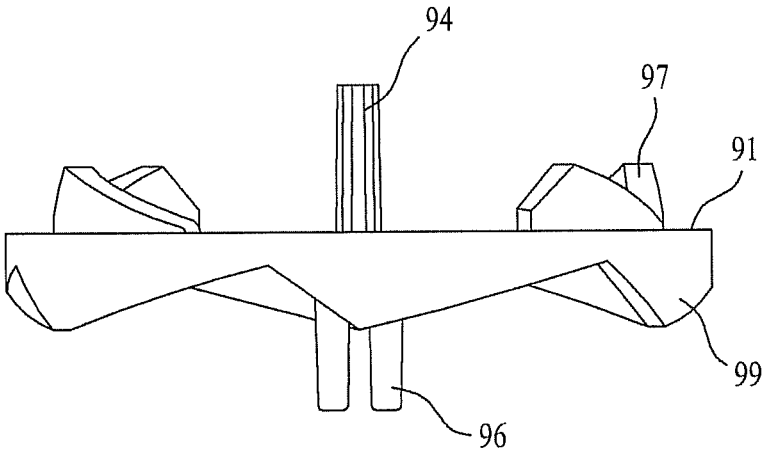

The channel switching part 9, which may alternately open the chamber communication hole 655 and the arm channel communication hole 657 according to an inner pressure of the lower arm chamber 69, may be provided in the lower arm chamber 69. As shown in FIG. 7, the channel switching part 9 may include a switching part body 91 positioned inside the lower arm chamber 69, a chamber opening hole 93 that penetrates the switching part body 91 to open the chamber communication hole 655, and an arm channel opening hole 95 that penetrates the switching part body 91 to open the arm channel communication hole 657.

The switching part body 91 may reciprocate between the bottom surface of the lower arm chamber 69 and the upper surface of the lower arm chamber 69 (the chamber partition wall 653) according to the water pressure in the lower arm chamber 69. The switching part body 91 may have a disc shape.

That is, when the water pressure in the lower arm chamber 69 is high, that is, when the wash water is supplied to the lower arm chamber 69, the switching part body 91 may move from the bottom surface of the lower arm chamber 69 toward the chamber partition wall 653. When the water pressure in the lower arm chamber 69 is low, that is, when the wash water is not supplied to the lower arm chamber 69, the switching part body 91, may move from the chamber partition wall 653 toward the bottom surface of the lower arm chamber 69.

An upper surface of the switching part body 91 may be provided with the detachable pipe guider 94 to guide reciprocating movement and rotational movement of the switching part body 91 and move the tower detachable pipe 51 toward the tower channel 31. The detachable pipe guider 94 may be inserted into the partition wall through-hole 658 provided in the chamber partition wall 653. Accordingly, when the switching part body 91 ascends and descends in the lower arm chamber 69, the detachable pipe guider 94 may also ascend and descend in the detachable pipe chamber 67.

The tower detachable pipe 51 may be provided in the detachable pipe chamber 67, and the tower detachable pipe 51 may be provided with the guider support 515 by which the detachable pipe guider 94 may be supported. Accordingly, when the switching part body 91 reciprocates in the lower arm chamber 69, the tower detachable pipe 51 may be moved toward the tower channel 31 by the detachable pipe guider 94. Therefore, failure of coupling of the tower detachable pipe 51 to the detachable pipe coupling part 45 due to low water pressure in the detachable pipe chamber 67 may be prevented.

The switching part body 91 may be further provided with gears 97 and 99 coupled to the upper gear engagement part 693 and lower gear engagement part 695 to rotate the switching part body 91. The gears may include upper gear 97 provided to or at an upper surface of the switching part body 91 to be coupled to the upper gear engagement part 693, and lower gear 99 provided to or at a lower surface of the switching part body 91 to be coupled to the lower gear engagement part 695. The upper gear 97 is a means to rotate the switching part body 91 clockwise (or counterclockwise) by being coupled to the upper gear engagement part 693, and the lower gear 99 is a means to rotate the switching part body 91 clockwise (or counterclockwise) by being coupled to the lower gear engagement part 695.

The lower gear 99 and the lower gear engagement part 695 may be arranged to rotate the switching part body 91 in the same direction in which the switching part body rotates when the upper gear 97 is coupled to the upper gear engagement part 693. The upper gear 97 and the upper gear engagement part 693 may be formed to be coupled to each other to rotate the switching part body 91 a predetermined angle clockwise (or counterclockwise), and the lower gear 99 and the lower gear engagement part 695 may be formed to be coupled to each other to rotate the switching part body 91 a predetermined angle.

In a case that the chamber communication hole 655 and the arm channel communication hole 657 provided in the lower arm 6 are arranged spaced approximately 90 degrees apart from each other, a center of the chamber opening hole 93 and a center of the arm channel opening hole 95 may be disposed on a straight line passing through a center of rotation C of the switching part body 91, as shown in FIG. 7. In this case, the upper gear engagement part 693 and the upper gear 97 may have shapes that cause the switching part body 91 to rotate clockwise (or counterclockwise) approximately 45 degrees by being engaged with each other to open one of the chamber communication hole 655 or the arm channel communication hole 657.

The lower gear engagement part 695 and the lower gear 99 may have shapes that cause the switching part body 91 to rotate approximately 45 degrees clockwise (or counterclockwise) by being coupled to each other. Unlike the above example, the chamber opening hole 93 and the arm channel opening hole 95 may be spaced approximately 90 degrees apart from each other about the center of rotation C of the switching part body 91, and the chamber communication hole 655 and the arm channel communication hole 657 may be disposed on a straight line.

Further, the lower gear 99 may be provided along a circumferential surface of the switching part body 91 to contact the inner circumferential surface of the lower arm chamber 69. In this case, the lower gear 99 may also function to guide reciprocating movement of the switching part body 91 when the switching part body 91 reciprocates (ascends and descends) in the lower arm chamber 69.

The lower surface of the switching part body 91 may further include a switching part guider 96 to balance a weight of the switching part body 91 and guide reciprocation of the switching part body 91 in the lower arm chamber 69. The switching part guider 96 may be arranged to extend from the center of the switching part body 91 toward the inflow hole 691. The switching part guider 96 may have a length that allows one end thereof to remain inserted into the inflow hole 691 even when the upper gear 97 is coupled to the upper gear engagement part 693.

A center of gravity of the switching part body 91 may be positioned, by the switching part guider 96, at a location where the switching part guider 96 is provided. Accordingly, the switching part guider 96 may advantageously function to allow the switching part body 91 to remain balanced in the lower arm chamber 69.

Hereinafter, an operation of the dishwasher according to embodiments will be described with reference to FIGS. 8A-8C and 9A-9D.

Figure 8A:
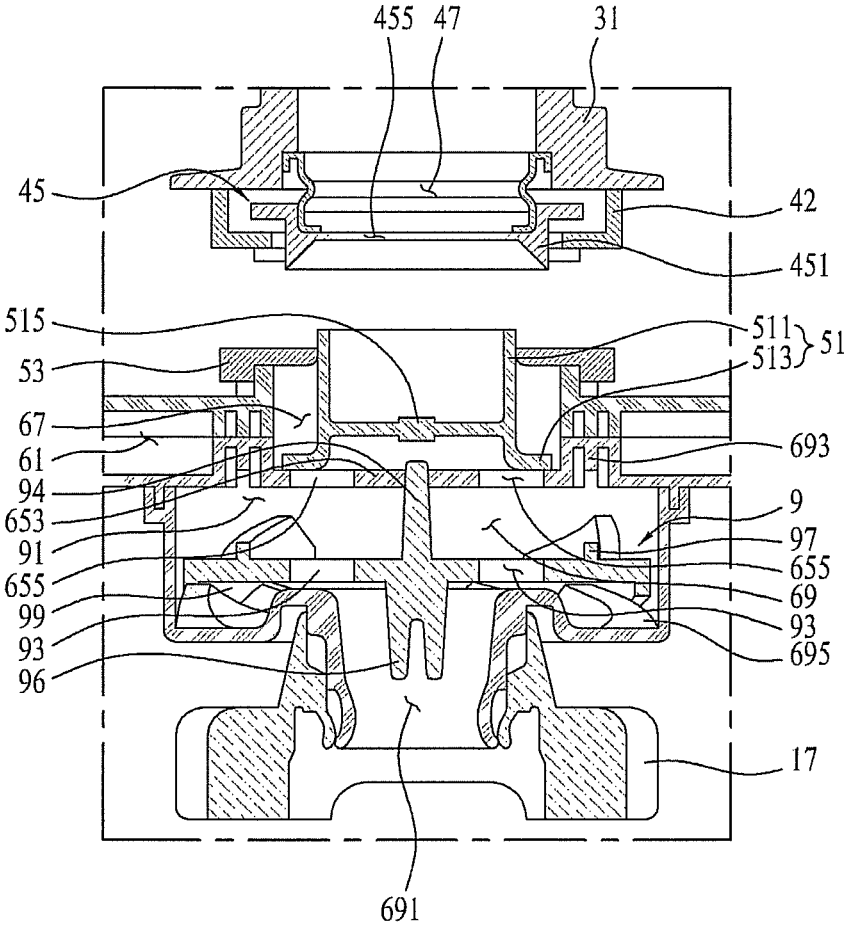
FIGS. 8A-8C and 9A-9D are views showing operations of the channel switching part and tower connection part provided to the dishwasher of FIG. 3.

As shown in FIG. 8A, when the water supply pump 18 does not operate and thus wash water is not supplied to the lower arm chamber 69, the channel switching part 9 may remain in contact with the bottom surface of the lower arm chamber 69. In this case, a center of the chamber opening hole 93 of the channel switching part 9 may remain spaced approximately 45 degrees apart from a center of the chamber communication hole 655, while a center of the arm channel opening hole 95 may remain spaced approximately 45 degrees apart from a center of the arm channel communication hole 657 (see FIG. 9A).

In addition, as the tower detachable pipe 51 remains seated on the chamber partition wall 653, the detachable pipe body 511 may not be connected to the tower channel 31. When the water supply pump 18 operates and thus wash water is supplied to the arm holder 17 through the first channel 21, the upper arm 7 and the top nozzle 8 may receive the wash water through the second channel 23, and the lower arm chamber 69 may receive the wash water through the arm holder 17.

Figure 8B:
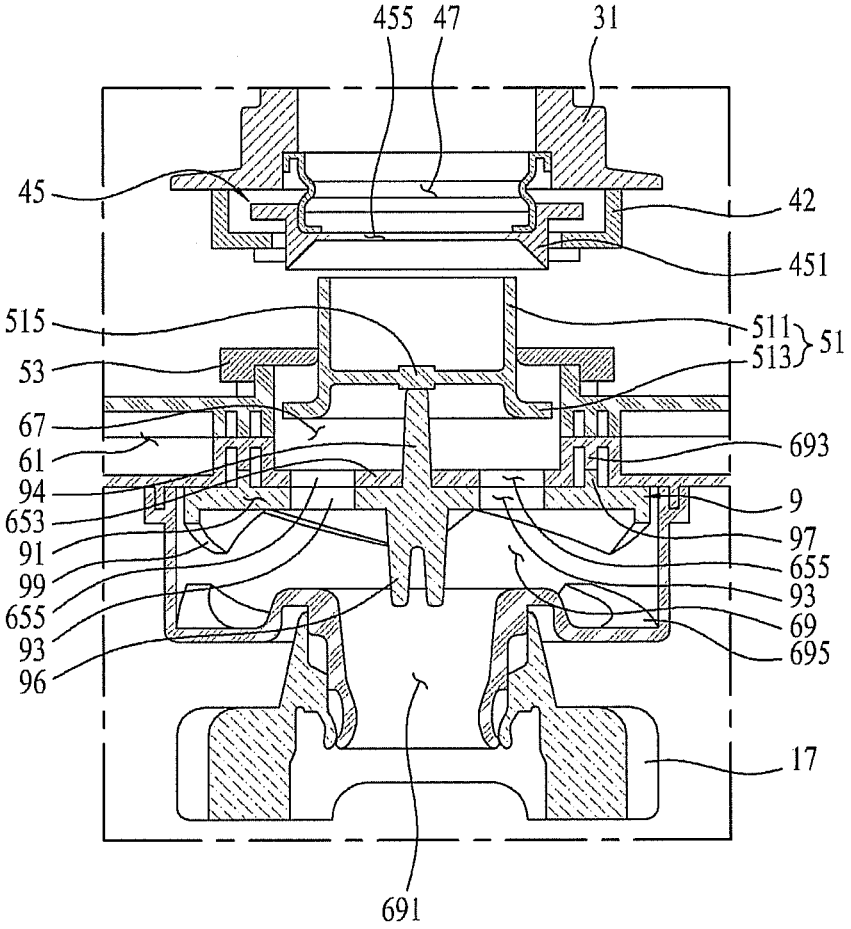
Figure 9A:
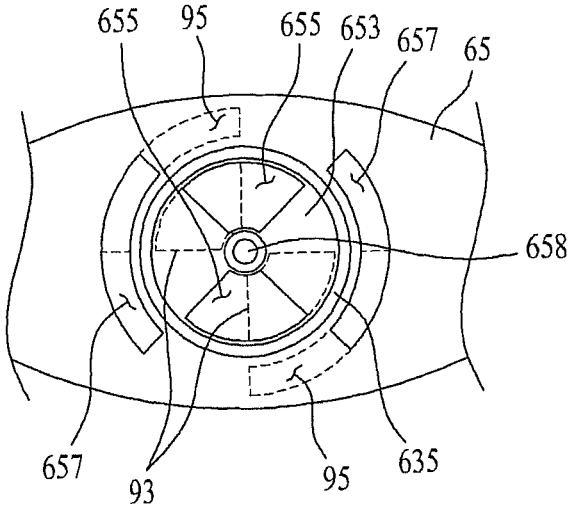
Figure 9B:
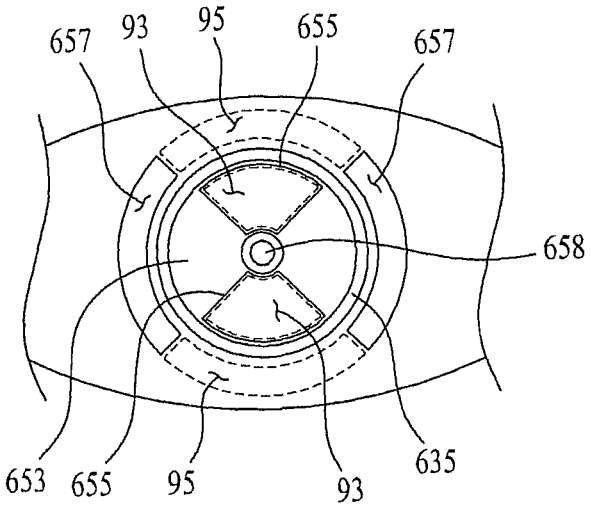

As shown in FIG. 8B, when the wash water is supplied to the lower arm chamber 69, the switching part body 91 may move from the bottom surface of the lower arm chamber 69 toward the chamber partition wall 653, and the upper gear 97 may be coupled to the upper gear engagement part 693. As shown in FIG. 9B, once the upper gear 97 is coupled to the upper gear engagement part 693, the switching part body 91 may rotate approximately 45 degrees clockwise (or counterclockwise) in the lower arm chamber 69. Thereby, the chamber opening hole 93 may open the chamber communication hole 655, and as the arm channel communication hole 657 remains closed by the switching part body 91, the wash water is not supplied to the arm channel 61.

In this case, the detachable pipe guider 94 inserted into the partition wall through-hole 658 may guide movement of the switching part body 91 from the bottom surface of the lower arm chamber 69 toward the chamber partition wall 653 and rotational movement of the switching part body 91. When the chamber communication hole 655 is opened by the chamber opening hole 93, the wash water in the lower arm chamber 69 may be introduced into the detachable pipe chamber 67. As the wash water is introduced into the detachable pipe chamber 67, the tower detachable pipe 51 may be raised in the detachable pipe chamber 67 by the water pressure.

In a case that the water pressure in the detachable pipe chamber 67 is low or a foreign substance exists between the outer circumferential surface of the tower detachable pipe 51 and the detachable pipe chamber 67, there is a risk of the tower detachable pipe 51 failing to be withdrawn from the detachable pipe chamber 67. However, according to this embodiment, the detachable pipe guider 94 inserted into the partition wall through-hole 658 may contact the guider support 515 to allow the tower detachable pipe 51 to be withdrawn from the detachable pipe chamber 67. Thereby, the risk as described above may be prevented.

Figure 8C:
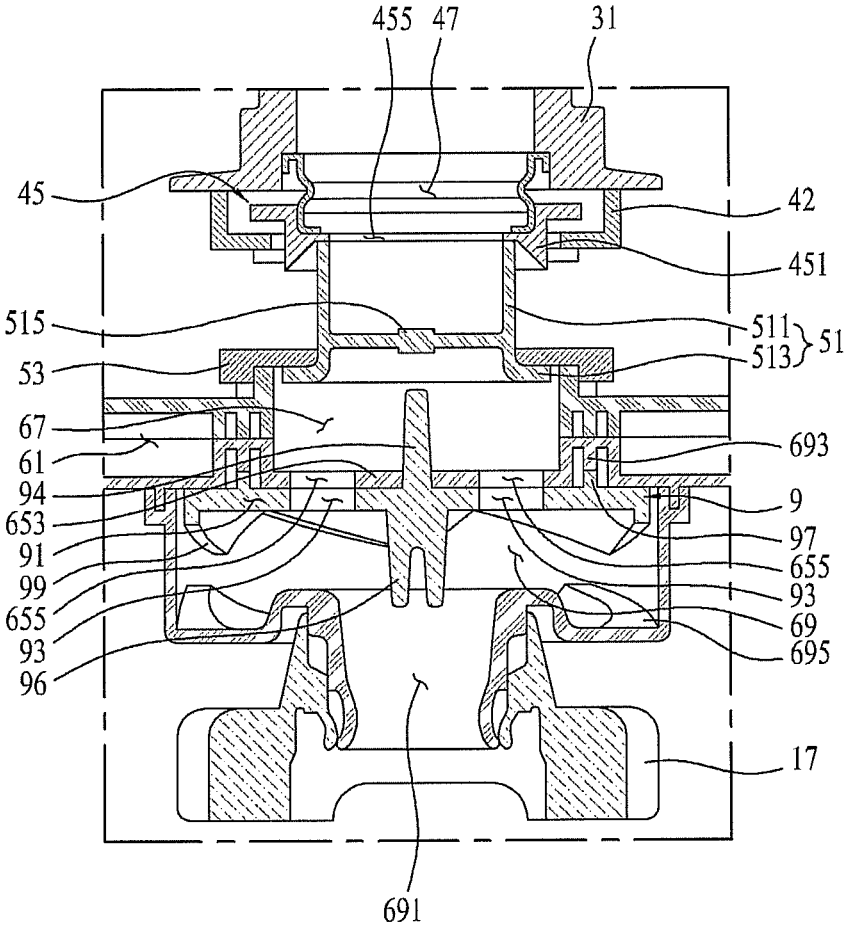

A length of the detachable pipe guider 94 may be a length by which the tower detachable pipe 51 is withdrawn from the detachable pipe chamber 67 until the tower detachable pipe 51 is connected to the detachable pipe coupling part 45. However, as shown in FIG. 8C, the detachable pipe guider 94 may have a length by which the tower detachable pipe 51 is moved to a level at which the detachable pipe flange 513 does not contact the arm fixing body 53, that is, a length shorter than the distance that the tower detachable pipe 51 is moved to be connected to the detachable pipe coupling part 45.

In a case that the detachable pipe guider 94 has a length that allows the tower detachable pipe 51 to be completely coupled to the detachable pipe coupling part 45, the upper surface of the switching part body 91 may not closely contact the chamber partition wall 653 due to tolerances of the detachable pipe guider 94 and the detachable pipe coupling part 45. Once the tower detachable pipe 51 is raised from the chamber partition wall 653 to a certain level by the detachable pipe guider 94, it may be completely withdrawn out of the detachable pipe chamber 67 and coupled to the detachable pipe coupling part 45 by water pressure in the detachable pipe chamber 67.

Once the tower detachable pipe 51 is completely withdrawn from the detachable pipe chamber 67, the detachable pipe body 511 may be inserted into the detachable pipe accommodation hole, and accordingly, the wash water in the detachable pipe chamber 67 may be supplied into the tower channel 31 and sprayed onto the upper rack 191.

In a case that the water supply pump 18 temporarily stops operating, wash water may not be supplied into the lower arm chamber 69, and accordingly, the switching part body 91 may move toward the bottom surface of the lower arm chamber 69. In this case, the lower gear 99 provided to the switching part body 91 may be coupled to the lower gear engagement part 695, and thus, the switching part body 91 may rotate approximately 45 degrees clockwise (or counterclockwise).

Figure 9C:
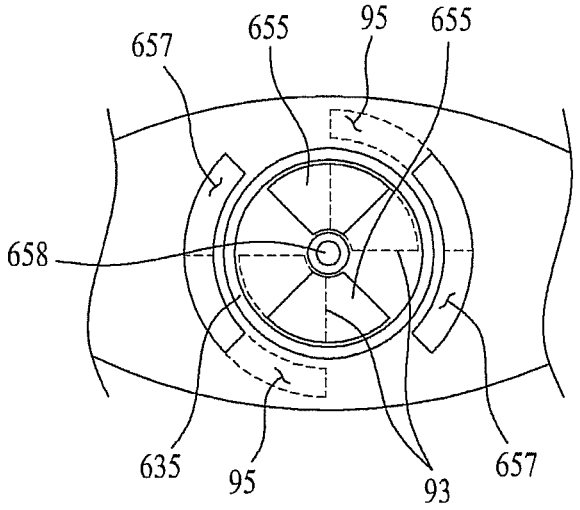

Accordingly, as shown in FIG. 9C, the center of the chamber opening hole 93 and the center of the chamber communication hole 655 may be arranged spaced approximately 45 degrees apart from each other, and the center of the arm channel opening hole 95 and the center of the arm channel communication hole 657 may also be arranged spaced approximately 45 degrees apart from each other. In addition, after being separated from the detachable pipe coupling part 45, the detachable pipe body 511 may move toward the chamber partition wall 653. Thereafter, when the wash water is re-supplied to the lower arm chamber 69 through the water supply pump 18, the switching part body 91 may move toward the upper surface of the lower arm chamber 69, and thus, the upper gear 97 may be coupled to the upper gear engagement part 693.

Figure 9D:
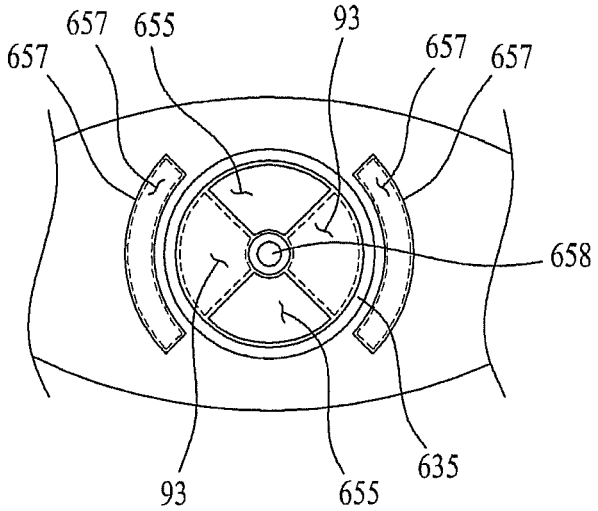

Once the upper gear 97 is coupled to the upper gear engagement part 693, the switching part body 91 may rotate approximately 45 degrees clockwise (or counterclockwise), and thus, the arm channel communication hole 657 may be opened by the arm channel opening hole 95 (see FIG. 9D). Once the arm channel communication hole 657 is opened by the arm channel opening hole 95, the wash water in the lower arm chamber 69 may be introduced into the arm channel 61, while the wash water is not supplied to the detachable pipe chamber 67 as the chamber communication hole 655 remains closed by the switching part body 91.

The wash water introduced into the arm channel 61 is sprayed onto the lower rack 193 and the sump cover 15 through the upper spray hole 631 and the lower spray hole 651 (see arrows). In this process, the lower arm 6 may rotate about the arm holder connection pipe 697. Thereafter, when the water supply pump 18 temporarily stops operating, wash water is not supplied into the lower arm-chamber 69, and thus, the switching part body 91 moves to the bottom surface of the lower arm chamber 69.

When the channel switching part 9 moves toward the bottom surface of the lower arm chamber 69, the lower gear 99 may be coupled to the lower gear engagement part 695, and thus, the channel switching part 9 may rotate approximately 45 degrees clockwise (or counterclockwise). Therefore, the center of the chamber opening hole 93 and the center of the chamber communication hole 655 may be arranged spaced approximately 45 degrees apart from each other, and the center of the arm channel opening hole 95 and the center of the arm channel communication hole 657 may be arranged spaced approximately 45 degrees apart from each other (see FIG. 9A).

As is apparent from the above description, embodiments disclosed herein provide at least the following advantages.

A dishwasher according to embodiments disclosed herein may increase washing efficiency and efficiently utilize the space of a tub in which washing objects are accommodated. In addition, a dishwasher having a spray arm to spray wash water onto a lower rack and a tower nozzle to supply wash water to an upper rack may be provided.

In addition, embodiments disclosed herein provide a dishwasher having a channel switching part that rotates according to a pressure of wash water to open one of a channel to supply the wash water to the spray arm and a channel to supply the wash water to the tower nozzle. Further, embodiments disclosed herein provide a dishwasher that prevents wash water supplied to the tower nozzle from leaking from the tower nozzle.

Accordingly, embodiments disclosed herein are directed to a dishwasher that substantially obviates one or more problems due to limitations and disadvantages of the related art.

Embodiments disclosed herein provide a dishwasher that may increase washing efficiency and efficiently utilize the space of a tub in which objects to be washed are accommodated. Further, embodiments disclosed herein provide a dishwasher having a spray arm to spray wash water onto a lower rack and a tower nozzle to supply wash water to an upper rack.

Embodiments disclosed herein provide a dishwasher having a channel switching part that rotates according to a pressure of wash water to open one of a channel to supply the wash water to the spray arm or a channel to supply wash water to the tower nozzle. Embodiments disclosed herein provide a dishwasher that prevents wash water supplied to the tower nozzle from leaking from the tower nozzle.

Embodiments disclosed herein provide a dishwasher that may include a tub that provides a washing space; a first rack positioned in the tub to accommodate an washing object, and a second rack positioned under the first rack; a lower arm provided with a lower arm chamber that allows wash water to flow thereinto, an arm channel that communicates with the lower arm chamber through an arm channel communication hole and sprays the wash water onto the second rack, a detachable part chamber separated from the lower arm chamber by a chamber partition wall, and a chamber communication hole provided in the chamber partition wall to allow the lower arm chamber to communicate with the detachable part chamber; a tower nozzle provided to the second rack to spray the wash water onto the first rack; a tower connection part withdrawable from the detachable part chamber according to water pressure in the detachable part chamber and adapted to supply the wash water to the tower nozzle when withdrawn from the detachable part chamber; and a channel switching part provided with a switching part body that reciprocates in the lower arm chamber according to water pressure in the lower arm chamber to alternately open the chamber communication hole and the arm channel communication hole, and a detachable pipe guider provided to the switching part body to move the tower connection part toward the tower nozzle by passing through the chamber partition wall.

The channel switching part may include a gear part provided to the switching part body to rotate the switching part body according to the water pressure in the lower arm chamber, an arm channel opening hole provided in the switching part body to open the arm channel communication hole according to a rotational angle of the switching part body, and a chamber opening hole provided in the switching part body to open the chamber communication hole according to a rotational angle of the switching part body. The lower arm chamber may include an inflow hole that allows the wash water to flow thereinto, a lower gear engagement part arranged to surround the inflow hole and to be coupled to the gear part, and an upper gear engagement part positioned over the lower gear engagement part and arranged to be coupled to the gear part.

The gear part may include a lower gear to rotate the switching part body by being coupled to the lower gear engagement part such that one of the chamber opening hole or the arm channel opening hole opens one of the chamber communication hole or the arm channel communication hole, and an upper gear to rotate the switching part body by being coupled to the upper gear engagement part such that the other one of the chamber opening hole or the arm channel opening hole opens the other one of the chamber communication hole or the arm channel communication hole. The channel switching part may further include a switching part guider that extends from a lower portion of the switching part body toward the inflow hole to allow the switching part body to remain balanced in the lower arm chamber. The switching part guider may have a length that allows the switching part guider to remain inserted into the inflow hole even when the upper gear is coupled to the upper gear engagement part.

The dishwasher may further include a rack fixing body provided to the second rack to fix the tower nozzle, a fixing body through hole arranged to penetrate the rack fixing body, a detachable pipe coupling part provided in the fixing body through hole and coupled to the tower connection part when the tower connection part is withdrawn from the lower arm, and an elastic support that connects the tower nozzle to the detachable pipe coupling part and supports the detachable pipe coupling part such that the detachable pipe coupling part is movable in the fixing body through hole. The rack fixing body may include a flange seating groove concavely curved toward the fixing body through hole. The detachable pipe coupling part may include a coupling part body fixed to the elastic support and inserted into the fixing body through hole, the coupling part body having a diameter smaller than a diameter of the fixing body through hole, a detachable pipe accommodation hole that penetrates the coupling part body and adapted to accommodate an outer circumferential surface of the tower connection part, and a coupling part flange formed along an outer circumferential surface of the coupling part body and supported by the flange seating groove. The detachable pipe coupling part may include an inclined surface provided to the coupling part body to guide the outer circumferential surface of the tower connection part into the detachable pipe accommodation hole.

Embodiments disclosed herein further provide a dishwasher that may include a tub that provides a washing space; a first rack positioned in the tub to accommodate an washing object, and a second rack positioned under the first rack; a lower arm positioned under the second rack to spray wash water onto the second rack; a tower nozzle provided to the second rack to spray the wash water onto the first rack; a tower connection part provided in the lower arm and withdrawable from the lower arm according to water pressure in the lower arm; and a rack fixing body provided to the second rack to fix the tower nozzle, a fixing body through hole arranged to penetrate the rack fixing body, a detachable pipe coupling part provided in the fixing body through hole and coupled to the tower connection part when the tower connection part is withdrawn from the lower arm, and an elastic support connecting the tower nozzle to the detachable pipe coupling part such that the detachable pipe coupling part is movable in the fixing body through hole.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a tub that provides a washing space;

a first rack positioned in the tub and a second rack positioned under the first rack, the first and second racks being configured to accommodate therein objects to be washed;

a lower arm provided with a lower arm chamber that allows wash water to flow thereinto, an arm channel that communicates with the lower arm chamber through an arm channel communication hole and sprays the wash water onto the second rack, a detachable pipe chamber separated from the lower arm chamber by a chamber partition wall, and a chamber communication hole provided in the chamber partition wall to allow the lower arm chamber to communicate with the detachable pipe chamber;

a tower nozzle provided to or on the second rack to spray the wash water onto the first rack; and a tower detachable pipe provided with a detachable pipe body having an open upper surface and an open lower surface and withdrawable from the detachable pipe chamber according to a water pressure in the detachable pipe chamber a detachable pipe flange that protrudes from an outer surface of the open lower surface, and a guider support fixed to an interior of the detachable pipe body;

a channel switching part provided with a switching part body that reciprocates in the lower arm chamber according to the water pressure in the lower arm chamber to alternately open the chamber communication hole and the arm channel communication hole; and a detachable pipe guider provided to or on the switching part body to move the tower detachable pipe toward the tower nozzle by passing through the chamber partition wall, wherein the detachable pipe guider contacts the guider support to allow the detachable pipe body to connect to or detach from the tower nozzle according to the water pressure.

2. The dishwasher according to claim 1, further comprising:

a switching part guider that extends from a lower portion of the switching part body to allow the switching part body to remain balanced in the lower arm chamber, wherein the channel switching part comprises:

at least one gear provided to or on the switching part body to rotate the switching part body according to the water pressure in the lower arm chamber;

at least one arm channel opening hole provided in the switching part body, the at least one arm channel opening hole being opened or closed according to a rotational angle of the switching part body; and at least one chamber opening hole provided in the switching part body, the at least one chamber opening hole being opened or closed according to the rotational angle of the switching part body.

3. The dishwasher according to claim 2, wherein the lower arm chamber comprises:

an inflow hole that allows the wash water to flow thereinto;

a lower gear engagement part arranged to surround the inflow hole and to be coupled to a lower gear of the at least one gear; and an upper gear engagement part positioned over the lower gear engagement part and arranged to be coupled to an upper gear of the at least one gear.

4. The dishwasher according to claim 3, wherein the lower gear rotates the switching part body by being coupled to the lower gear engagement part such that one of the at least one chamber opening hole or the at least one arm channel opening hole is opened thereby opening one of the chamber communication hole or the arm channel communication hole, and the upper gear rotates the switching part body by being coupled to the upper gear engagement part such that the other one of the at least one chamber opening hole or the at least one arm channel opening hole is opened thereby opening the other one of the chamber communication hole or the arm channel communication hole.

5. The dishwasher according to claim 4, wherein the switching part guider extends from a lower portion of the switching part body toward the inflow hole.

6. The dishwasher according to claim 5, wherein the switching part guider has a length sufficient to allow the switching part guider to remain inserted into the inflow hole even when the upper gear is coupled to the upper gear engagement part.

7. The dishwasher according to claim 1, further comprising:

a rack fixing body provided to or on the second rack to fix the tower nozzle;

a fixing body through hole that penetrates the rack fixing body;

a detachable pipe coupling part disposed in the fixing body through hole and coupled to the tower detachable pipe when the tower detachable pipe is withdrawn from the lower arm; and an elastic support that connects the tower nozzle to the detachable pipe coupling part and supports the detachable pipe coupling part such that the detachable pipe coupling part is movable in the fixing body through hole.

8. The dishwasher according to claim 7, wherein the rack fixing body comprises a flange seating groove concavely curved toward the fixing body through hole, and wherein the detachable pipe coupling part comprises:

a coupling part body fixed to the elastic support and inserted into the fixing body through hole, the coupling part body having a diameter smaller than a diameter of the fixing body through hole;

a detachable pipe accommodation hole that penetrates the coupling part body and adapted to accommodate an outer circumferential surface of the tower detachable pipe; and a coupling part flange formed along an outer circumferential surface of the coupling part body and supported by the flange seating groove.

9. The dishwasher according to claim 8, wherein the detachable pipe coupling part comprises an inclined surface provided on the coupling part body to guide the outer circumferential surface of the tower detachable pipe into the detachable pipe accommodation hole.

10. The dishwasher according to claim 1, wherein the tower nozzle comprises:

a spray nozzle; and a tower channel that guides wash water to the spray nozzle.

11. The dishwasher according to claim 10, wherein the tower channel is in the form of a cylinder having upper and lower ends open.

12. The dishwasher according to claim 11, wherein a diameter of the tower channel decreases as it extends in an upward direction.

13. The dishwasher according to claim 10, wherein the spray nozzle is rotatable and comprises a plurality of spray holes arranged on an upper surface of the spray nozzle, such that the spray nozzle rotates due to a repulsive force of wash water discharged through the plurality of spray holes.

14. The dishwasher according to claim 1, wherein the lower arm comprises an upper frame and a lower frame that form the arm channel.

15. The dishwasher according to claim 14, wherein the lower arm further comprises at least one spray hole disposed in a surface of the upper frame.

16. The dishwasher according to claim 15, wherein the lower arm further comprises at least one spray hole disposed in a surface of the lower frame.

* * * * *